United States Patent [19]

Dain et al.

[11] 4,063,940

[45] Dec. 20, 1977

[54] MAKING OF ARTICLES FROM METALLIC POWDER

[76] Inventors: Richard James Dain, Hurst Wood Farm, Crouch, near Borough Green, Kent; Hugh Ford, 18 Shrewsbury House, Cheyne Walk, London S.W.E., both of England

[21] Appl. No.: 691,697

[22] Filed: June 1, 1976

Related U.S. Application Data

[63] Continuation-in-part of Ser. No. 578,787, May 19, 1975, abandoned.

[51] Int. Cl.[2] ..... B22F 1/00

[52] U.S. Cl. ..... 75/213; 75/211; 75/214; 75/225; 75/246; 148/126

[58] Field of Search ..... 148/126; 75/225, 211, 75/213, .5 C, 214

[56] References Cited

U.S. PATENT DOCUMENTS

| | | | |
|---|---|---|---|
| 3,460,940 | 8/1969 | Talmage | 75/225 X |
| 3,744,993 | 7/1973 | Matt et al. | 148/126 X |
| 3,937,630 | 2/1976 | Kimura et al. | 75/200 X |
| 3,954,458 | 5/1976 | Roberts | 75/200 |

OTHER PUBLICATIONS

Goetzel, C. G., Treatise on Powder Metallurgy, vol. I, pp. 235, 253–257, 622–623, Interscience, N.Y., 1944.

*Primary Examiner*—Richard E. Schafer
*Attorney, Agent, or Firm*—Blum, Moscovitz, Friedman & Kaplan

[57] ABSTRACT

The invention relates to making articles from metallic powder, particularly of tool steel, alloy steel and stainless steel and cobalt based hard metal powders, of high density and quality. The powder is compacted to at least 65% density and heated in the compacted form in two stages, firstly to deoxidize it preferably to less than 400 p.p.m. oxygen content and secondly to sinter it at least at the solidus temperature of the powder to produce a compact of at least 98% relative density. Normally the powder is annealed before compaction to soften it to a condition in which it can be compacted at pressures of 15 to 40 t.s.i. to densities of at least 65%.

17 Claims, No Drawings

MAKING OF ARTICLES FROM METALLIC POWDER

CROSS-REFERENCE TO RELATED APPLICATION

This is a continuation-in-part application of our application Ser. No. 578,787, filed May 19, 1975 now abandoned for IMPROVEMENTS IN OR RELATING TO THE MAKING OR ARTICLES FROM METALLIC POWDER.

BACKGROUND OF THE INVENTION

The present invention relates to the making of articles from high alloy powders, and in particular tool steel powders and cobalt based hard metal powders. By "powder" in this context is meant alloys in particulate, granular, or powder form. The powder may optionally be blended with minor additions of metal oxide powders or non-metallic powders.

The tool steel powder is first compacted under a high pressure to form a compact in which the powder particles are locked together mechanically. The resulting compact, which has a reasonably high strength, approximates in shape to the final product but may be machined closer to the desired shape subsequently. The compact however does have significant porosity and requires further treatment to bring it to a fully dense form. That further treatment usually consists of sintering the compact, with or without the application of pressure, i.e., the raising of the temperature sufficiently high to bring some at least of the components of the powder into liquid phase to fill such pores as exist in the compact. Provided the sintered compact has a uniform and or high relative density, the final product retains high dimensional accuracy and has mechanical properties indistinguishable from a conventionally made product.

Particularly when the powder has been made by water atomization of a melt, the powder has an undesirably high oxygen content, even when measures are taken to minimize surface oxidation during and subsequent to atomization. The presence of oxygen in combined form in the compact or in the final product has a deleterious effect, resulting for example in inferior strength.

In the past, attempts have been made to reduce the oxygen content by subjecting the powder, prior to compacting, to heat treatment aimed at deoxidizing the powder. Thus Matt et al. (U.S. Pat. No. 3,744,993) suggest deoxidizing tool steel powder at about 1750° – 1875° F in hydrogen to bring the oxygen content of the powder to 0.30 to 0.25%; no further reduction in oxygen content is proposed as the presence of the stated proportion of oxygen was thought to be beneficial. Matt et al also propose that the compact is sintered in a hydrogen or carbonaceous atmosphere; a vacuum atmosphere is deprecated because it was thought that in vacuum significant vaporization of contained chromium occurred, to the detriment of the final product.

Contrary to Matt el al. we have found that a. for proper mechanical properties in the finished product, the oxygen content should be reduced well below the figure of 0.25% and the required degree of deoxidation cannot be achieved by treatment of the uncompacted powder in a hydrogen atmosphere;

b. the compact can be safely heat treated at elevated temperature in relatively high vacuum, without significant vaporization of the contained chromium occurring to any damaging extent.

One object of the present invention is to achieve more efficient deoxidation by deoxidizing at higher temperatures. This is achieved by at least completing deoxidizing the powder in its compact form.

Another object is to achieve substantially fully dense articles made from tool steel, alloy steel, stainless steel or cobalt based hard metal powders by substantially densifying the compact during sintering.

SUMMARY OF THE INVENTION

The present invention provides a method of making a dense metal alloy product from metallic powder which may contain non-metallic additions which comprises the steps of a. compacting powder and thereby forming a compact with a relative density of at least 65%;

b. heating said compact at a sub-atmospheric pressure in order to reduce the oxygen content of the compact; and c. raising the temperature to at least the solidus temperature of the alloy while maintaining a sub-atmospheric pressure to sinter the compact and cause densification of the compact to at least 98% relative density. "Relative density" is the ratio of the actual density of the compact to the density of the solid material from which it is made, expressed as a percentage.

Deoxidation is intended to mean a reduction of oxygen content as well as the complete removal of oxygen. Normally, deoxidation will mean a reduction in oxygen content to at most 1,000 p.p.m. and preferably to a content in the range 400 – 60 p.p.m. or below. Typically a reduction from 1,800 – 60 p.p.m. might be required.

By deoxidizing the powder in the compacted form a higher temperature can be used, preferably in the range 1,050° – 1,200° C but below the solidus temperature of the alloy, and the deoxidizing and sintering steps can be combined into a single heating cycle.

By substantially eliminating all the voids in the article during the sintering step an article of high density and good metallurgical bond is achieved.

DETAILED DESCRIPTION OF THE PREFERRED EMBODIMENTS

The metallic powder is preferably made by atomizing a falling stream of molten alloy by water jets directed at the stream and water quenching the resultant hot alloy droplets in such a manner as to give irregular shaped particles. Powder made by such water atomization has the advantage of good compactability, which facilitates the subsequent formation of the compacts.

Thus, an alloy of the required metallurgical composition is melted in a conventional induction melting furnace and the melt is poured at a temperature corresponding to 100° – 150° C superheat into a preheated refractory-lined tundish from which it runs by gravity through a refractory nozzle in the base of the tundish into a water sealed atomization chamber which is purged by nitrogen flow and the base of which is immersed in a water bath. Atomization is preformed by two pairs of opposed jets of water directed at the melt falling melt through the chamber from the tundish nozzle; each jet is in the form of a flat plane, the upper pair intersecting in a line above and at right angles to the line of intersection of the lower pair. The stream of molten metal is shattered into droplets by the jet system while the droplets are solidified by impact with the water of the jets and of the bath. The energy of the jets is also applied to cause a recirculation of the water in the bath away from the point of intersection of the jets with the water bath.

Surface oxidation is minimized by the rapid freezing of the droplets after formation, by the nitrogen atmosphere within the atomization chamber, and by the inclusion of amine-based anti-oxidant in the jets and the water bath.

The solid, irregularly shaped, metal particles fall into the water bath from which they are removed by a pump or by an electromagnet. The metal powder so formed in treated with neat anti-oxidant and dried in shallow trays at a temperature of 35° - 40° C, the depth of the powder in the trays being about ½ - 1 inch.

The dried powder is reloaded into shallow trays to 1 - ½ inch depth, placed in a vacuum furnace, heated to 1,000° - 1,050° C and held at that temperature for 2 to 10 hours, depending on the size of the load, in a vacuum better than 0.1 torr. until evolved gases are removed. Then the powder is subjected to controlled cooling until it is below the critical range of temperature, e.g. 600° to 700° C, at a rate of 25° to 50° C per hour for high speed tool steels, and is finally allowed to furnace cool to ambient. Provided that starting carbon content of the powder is 0.95%, the heat treatment not only anneals a high speed tool steel powder but also reduces the oxygen content to below 750 p.p.m.

Taking as an example a high speed tool steel, the annealed powder is milled, sieved through a 60 mesh sieve, and then mixed with 0.5 to 1.0% magnesium stearate, up to 0.2% carbon in graphite form, and, if required, fine cobalt powder. The carbon addition gives close control of the final carbon content, an important feature is obtaining accurate temperature of sintering. The stearate acts as a lubricant in the mechanical pressing of the compact, while the cobalt powder may be added to correct the metallurgical composition, or to act as a grain refiner. The addition of lubricants, however, can reduce the pressure required to obtain satisfcatory relative densities. For example, the addition of metallic stearates in the range 0.5 to 1.0% by weight can reduce the desirable pressure range to 60,000 to 100,000 psi.

The annealing produces a "soft" powder which has compactability, and which therefore produces a compact having a high relative density.

The compacts are made in any of a number of differing ways, depending on the final article. Thus, where a complex shape, such as a tool, is to be produced, the powder may be packed into a mold of stiffly deformable material having a shape approximating to the shape required of the article, and the powder-filled mold subjected to isostatic compression to form the compact. Alternatively the powder may be pressed into compacts in a mechanical press at moderate pressure. Again, the powder may be performed uni-directionally in a die mounted in a ram press under relatively low pressure to the required shape, the preform given a protective coating sealing the pores of the preform, and the coated preform then subjected to isostatic compression at a relatively high pressure. In the last case, the loosely compacted preform, after removal from the die, is preferably coated with a rubber or plastic material, as by spraying or dipping.

The compacting pressure employed vary with the quality of the powder and the dimensional accuracy required in the final products, but are always in excess of 15 tons per square inch. Thus, satisfactory sintered parts are produced from high quality powder by compacting in a conventional mechanical press at a pressure of 15 to 25 tons per square inch, giving a relative density above 65%. Where close dimensional control is important, higher pressures of the order of 30 to 50 tons per square inch are used, giving relative densities or 75 to 85%. These higher pressures may be required to obtain high quality products from lower quanlity powder.

When sufficiently high compaction pressures are used it is possible to profile the compact by normal metal cutting operations after compaction and before sintering. By this method a much higher rate of removal of material is possible than on sintered or conventionally made material.

Where a composite article is to be made, a powder of a first composition may be introduced into a compressible mold around a metallic insert of a second composition, and the mold subjected to isostatic compression; the subsequent sintering of the resulting compact bonds the surrounding powder metallurgically to the insert. The insert may be a solid metal member formed previously from powder or by conventional means, or the insert itself may consist of previously compacted powder or of uncompacted powder having a composition differing from that of the surrounding powder. The insert need not be of tool steel, alloy steel or stainless steel.

Where the powder is compacted into contact with a mandrel, by choosing a mandrel which does not bond with the powder metallurgical in sintering, it is possible to retain the mandrel shape through the sintering step, only removing the mandrel after sintering. Using this method complex section female dies or similar components with good mechanical properties can be formed to very close tolerances.

The compacts are heat treated firstly to remove the stearate lubricant, secondly for deoxidation, and thirdly to sinter and densify the compacts. For that purpose, the compacts are loaded into a vacuum furnace maintained at a vacuum of at least $10^{-3}$ torr., and preferably $10^{-4}$ torr., and the temperature raised to a value between200° and 600° C, and held for ½ hour to 2 hours until all included lubricant is outgassed. The temperature is then raised to a value 75° to 150° C and preferably about 100° C below that employed for sintering the particular metallurgical composition in use to full density and the temperature maintained for ½ to 2 hours with the aim of removing substantially all carbon oxides. Finally the temperature is again raised to the sintering temperature which is held accuractely for a period of sufficient time (½ hour to 4 hours) to cause sintering throughout each compact and to obtain substantially complete densification.

Metallic volatiles may be suppressed by worsening the vacuum somewhat above the temperature at which such volatiles are emitted. Typically, a vacuum of $10^{-4}$ torr. employed up to 1,100° C may be worsened to 1.0 torr. for higher temperatures by the injection of an inert or reducing gas, e.g., nitrogen, hydrogen, argon or helium. Different gases may be used at different temperature levels. It is preferred to supply such gases and alternately raise and lower its pressure to scavenge carbon monoxide and carbon dioxide from the interior of the compact. For example, the furnace chamber may be alternatively back-filled with inert gas to 0.2 - 1.0 torr. and re-evacuated to a pressure of 0.50 - 0.1 torr., this cycle being repeated as often as required.

The temperature at which sintering is effected is critical and is dependent on the composition of the compacts being treated; examples of sintering temperatures for different compositions are given subsequently. Too high a temperature leads to carbide growth, grain growth and segregation and consequential embrittlement of the final products, while too low a temperatue results in insufficiently densification. Because sintering temperature is critical, it must be held within close limits during period of sintering, and has been found in practice to require to be held to an accuracy of ± 10° C and preferably ± 1 ½° C.

The sintering temperature selected is at or slightly above the solidus temperature of the steel of the compacts. At that temperature the lower melting temperature solidus composition of the steel are brought into the liquid phase while the other compositions remain in the solid phase. By so doing, the sintering processes of volume diffusion, internal mass flow and formation of solid solutions and other chemical compounds are accelerated, and, at the same time, surface tension pressures are generated sufficient to collapse the majority of the pores within the compact and to cause voids to diffuse to the surface of the compact so as to achieve a density which approximates to the full density of the steel from which the compact is formed. Typically for a tool steel the sintering may take place in the temperature range 1,180° to 1,280° C for a period of a ½ hour to 4 hours.

After sintering, the compacts are cooled and annealed in conventional manner.

The invention will be more readily understood by the following description of methods of making tool steel articles in accordance therewith.

EXAMPLE 1

The tool steel melt had the following composition besides iron:

carbon — 1.2% — vanadium 2%
tungsten — 6% — manganese < 0.2%
molybdenum — 5% — surphur < 0.03%
chromium — 4% — phosphorous < 0.03%

All percentages are given by weight.

Steel powder was made from the melt, dried, annealed, milled, sieved, and mixed with lubricant and graphite as described above. Compacts were passed from the powder in a mechanical press at a pressure of 35 tons per square inch. The compacts had a relative density of between 75 and 80% and the composition was 0.85% C, 6.0% W, 5.0% Mo., 4.0% Cr, 2.0% V. The reduction in carbon occurred during annealing with its attendant deoxidation.

The compacts were loaded on to small alumina pads and placed on carbon dies in a cylindrical heated vacuum furnace, being stacked on the discs one above another. The close spacing of the discs, together with the use of low emissivity radiation shields above and below and around the charge, enabled close control of furnace temperature to be achieved. The pressure within the furnance was lowered to, and maintained at, $10^{-4}$ torr. After removal of the lubricant and deoxidation as described, the compacts were sintered at a temperature of 1,217° C which was held for a period of 3 hours, with an accuracy of ± 1 ½° C. The sintered compacts were found to have a porosity of less than 2% (relative density greater than 98%) and a maximum carbide size of 10 microns. The oxygen content was below 150 ppm.

EXAMPLE II

Compacts were made as in Example I, except that the steel melt had a composition of carbon — 1.2% — vanadium 2%
tungsten — 6% — cobalt 5%
molybdenum — 5%
chromium — 4% and the compact composition contained 0.85% carbon, and the other components unchanged. The sinter temperature in this case was 1,215° C and sinter duration 3 hours.

EXAMPLE III

The composition of the melt in this case was carbon — 1.2% — chromium 4%
tungsten — 1.5% — vanadium 1.2%
molybdenum — 9.5% — cobalt 5% composition of the compacts being the same, except that the carbon content was 0.80%. The sinter temperature employed was 1,212° C and the sinter duration was 1 hour.

According to the required final product and the method of making the compact, the sintered compact may require little further work on it other than surface finishing, or may be hotworked to improve its properties. It can then be machined to form the final tool. This hotworking may take the form of forgoing, open or closed pass rolling or rotary swaging.

Alternatively, the process of surface finishing may be combined with a densification step by the use of cold swaging, cold forgoing, or by cold drawing through rolls, which should be of a hard material, such as tungsten carbide.

What is claimed is:

1. A method of making a dense metal alloy product comprising the steps of:

a. making powder by atomization of a melt of metal alloy;
b. heating the powder in a sub-atomspheric pressure and cooling the powder at a controlled rate initially to deoxidize it and anneal it;
c. compacting alloy powder and thereby forming a compact with a relative density of at least 65%;
d. heating said compact at a sub-atmospheric pressure but below the solidus temperature for at least half an hour in order to further reduce the oxygen content of the compact; and
e. raising the temperature to a selected sinter temperature which is at least the solidus temperature of the alloy while maintaining a sub-atmospheric pressure and maintaining the temperature within ± 10° C of the selected temperature for at least half an hour to sinter the compact and cause densification of the compact to at least 98% relative density.

2. A method of making a dense product according to claim 1, in which the heating of the compact is performed in a vacuum better than $10^{-3}$ torr.

3. A method of making a dense product according to claim 1, in which the powder is mixed with a lubricant prior to compaction, and said lubricant is removed by volatilization prior to sintering.

4. A method of making a dense product according to claim 3, in which said heating of said compact is performed in vacuum and in three stages, comprising succesively a. a temperature of between 200 and 600 C to volatilize said lubricant for at least ½ hour;

b. a temperature below the solidus temperature for deoxidation, and initiation of solid phase sintering for at least ½ hour, and c. a temperature near said solidus temperature to complete densification for at least ½ hour.

5. A method of making a dense product according to claim 1, in which during said powder heating in a vacuum prior to compaction the powder is heated above 1000° C for at least 2 hours.

6. A method of making a dense product according to claim 1, in which during said powder heating prior to compaction the powder is heated in vacuum to a temperature of at least 1,000° C, and is then subject to controlled cooling at least until it has cooled to below the critical temperature range at a cooling rate between 25° C and 50° C per hour.

7. A method of making a dense product according to claim 1, in which said compacting is performed in a mechanical press at a pressure in excess of 15 tons per square inch.

8. A method of making a dense product according to claim 1, in which the temperature during sintering is controlled to ± 1½° C of the selected sintering temperature.

9. A method of making a dense product according to claim 1, in which said heating of the compact for deoxidation is performed at a temperature of about 100° C below the solidus temperature of the steel.

10. A method of making a dense product according to claim 1, in ; which the compact is heated and during the heating the atmosphere is alternately evacuated and replaced by a gas selected from the group comprising inert and reducing gases with the objective of maintaining a low partial pressure of oxygen.

11. A method of making a dense metal alloy article from metallic powder which comprises:

1. making powder by atomization of a melt of metal alloy;
2. heating the powder in a vacuum at a temperature above 1,000° C for at least 2 hours and cooling the powder at a controlled rate initially to deoxidize it and anneal it;
3. adding a lubricant to the powder and subjecting it to a pressure in excess of 15 t.s.i. to form a compact with a relative density of at least 65%;
4. heat treating the compact in a vacuum in three stages of which:
   a. in one stage the compact is heated to 200° to 600° for at least half an hour until the lubricant is substantially all outgassed;
   b. in a second stage the compact is heated at a temperature 75° to 150° C below the solidus temperature of the powder for a period of at least ½ hour to reduce the oxygen content to below 400 p.p.m.
   c. in a third stage the compact is heated to a selected sinter temperature at least at the solidus temperature of the powder and maintained within ± 10° C of the selected temperature for at least ½ hour to achieve a relative density of at least 98%.

12. A method according to claim 1 in which said heating of the powder prior to compaction reduces the oxygen content of the powder below 750 p.p.m.

13. A method according to claim 1 which comprises adding up to 0.2% carbon to the powder after said initial deoxidation of the powder.

14. A method according to claim 1 which comprises, to achieve said further deoxidation of the compact, heating the compact at a temperature 75° to 150° C below the solidus temperature of the powder for at least half an hour.

15. A method according to claim 11 in which said heating of the powder prior to compaction reduces the oxygen content of the powder below 750 p.p.m.

16. A method according to claim 11 which comprises adding up to 0.2% carbon to the powder after said initial deoxidation of the powder

17. A method according to claim 11 which comprises controlling the temperature during sintering to within 1½% of the selected sintering temperature.

* * * * *